US006874454B2

(12) United States Patent
Paut

(10) Patent No.: US 6,874,454 B2
(45) Date of Patent: Apr. 5, 2005

(54) TWO-STROKE CYCLE FOR INTERNAL COMBUSTION ENGINES

(76) Inventor: Drazen Paut, Ivana Gundulica 28, Split (HR), 21000

( * ) Notice: Subject to any disclaimer, the term of this patent is extended or adjusted under 35 U.S.C. 154(b) by 0 days.

(21) Appl. No.: 10/380,164

(22) PCT Filed: Sep. 14, 2001

(86) PCT No.: PCT/HR01/00041

§ 371 (c)(1),
(2), (4) Date: Mar. 18, 2003

(87) PCT Pub. No.: WO02/25078

PCT Pub. Date: Mar. 28, 2002

(65) Prior Publication Data

US 2004/0025816 A1 Feb. 12, 2004

(30) Foreign Application Priority Data

Sep. 22, 2000 (HR) ..... P 20000632 A

(51) Int. Cl.[7] ..... F02B 33/22
(52) U.S. Cl. ..... 123/70 R; 123/65 PE
(58) Field of Search ..... 123/66–72, 65 PE

(56) References Cited

U.S. PATENT DOCUMENTS

| | | | | |
|---|---|---|---|---|
| 5,709,177 A | * | 1/1998 | Worth et al. | 123/65 PE |
| 5,884,590 A | * | 3/1999 | Minculescu | 123/71 R |
| 6,026,769 A | * | 2/2000 | Anbarasu et al. | 123/70 R |
| 6,352,057 B1 | * | 3/2002 | Drecq | 123/66 |
| 6,571,755 B1 | * | 6/2003 | Dunn et al. | 123/70 R |

FOREIGN PATENT DOCUMENTS

| | | |
|---|---|---|
| CH | 105074 | 9/1923 |
| DE | 277410 | 8/1914 |
| EP | 1018597 A1 | 7/2000 |
| FR | 2708668 | 2/1995 |
| GB | 2191537 A | 12/1987 |
| JP | 59-96432 | 2/1984 |

* cited by examiner

*Primary Examiner*—Marguerite McMahon
(74) *Attorney, Agent, or Firm*—Jacobson Holman PLLC

(57) ABSTRACT

A two-stroke cycle is applicable to classical internal combustion engines (piston-rod-crankshaft) as well as to engines with a two-sided piston. At least one pair of cylinders of which one is a compressor (pump) cylinder and other is an engine cylinder. The compressor and the engine pistons have such a phase delay to each other that when one piston is in the midpoint between two "dead points" of the engine, the other is in one of the "dead points". At the moment when the compressor piston has passed half the way from the lower dead point (LDP) to the upper dead point (UDP), it also has precompressed the sucked air, while the engine piston is at LDP and has opened an exhausting channel, which lets out the combustion gas. Because of the higher pressure in the compressing pipe relating to the pressure in the engine cylinder, an inlet valve of the engine opens and fresh air enters the engine. When the compressor piston comes to the UDP, it delivers all the air to the engine and a spring force closes the inlet valve of the engine. In the meantime the engine piston has closed the exhausting channel and the an injector has injected the fuel into the engine cylinder. The engine piston keeps on compressing the air-fuel compound until the UDP has been reached. The sparking plug starts the ignition, while the compressor piston goes towards the LDP, sucking the air. The cycle is repeated.

3 Claims, 4 Drawing Sheets

TWO-STROKE CYCLE FOR INTERNAL COMBUSTION ENGINES

This is a nationalization of PCT/HR01/00041 filed Sept. 14, 2001 and published in English.

TECHNICAL FIELD

Classical piston engines (piston-rod-crankshaft) performed as "V" engines (FIG. 3), "boxer" engines, "star" engines, "H" engines.

Engines with double pistons placed at an angle of 90 degrees to each other (FIG. 1).

Engines with two-sided pistons (FIG. 2).

To resolve the problem means to improve the cycle of two-stroke engines.

BACKGROUND ART

Two-stroke engine performances already existing:

Inlet regulation via a valve controlled by the cam shaft, while exhaustion is enabled via a channel in the cylinder.

Cylinder charging and discharging regulation via a through-hole of the transverse scouring system, with the assistance of the deflecting piston's bottom.

Cylinder charging and discharging regulation via a through-hole in the cylinder and by means of the withdrawal scouring.

Cylinder charging and discharging regulation via a through-hole and by means of the one-way scouring with the double-cylinder applied.

Regulation of the exhaustion via a valve controlled by the cam shaft, and inlet is provided via a through-hole in the cylinder.

Cylinder charging and discharging regulation via a valve controlled by the cam shaft, It should be mentioned that an installation of the rotative valve in every exhausting through-hole is possible.

DISCLOSURE OF THE INVENTION

It is essential for the present invention that two cylinders work in yoke. One cylinder acts as compressor (pump) (1), while the other acts as engine (2). Pistons in the cylinders have the phase delay to each other in way that the compressor piston (3) is advanced with respect to the engine piston (4) as much as half of the stroke, meaning, when one of the pistons is in upper or in lower dead point (UDP or LDP), the other piston is in the midpoint between UDP and LDP, and vice-versa FIG. 4 shows entire two-stroke cycle scheme of the present invention, where the compressor cylinder (1) and the engine cylinder (2) are drawn near each other for the sake of simplicity. Every particular kind of engine performed according to the present invention is shown in FIGS. 1, 2, and 3. The very cycle elapses in one crankshaft revolution. FIG. 4*a* displays the moment when the compressor piston (3) is in its stroke midpoint, while the engine piston (4) is in the lower dead point (LDP). In this moment the compressor has precompressed the air, while combustion gas has almost entirely left the engine via the exhausting channel (15).

Because of the higher pressure in the compressor and in the compressing pipe (5) than in the engine, the pressure difference overcomes the spring (6) force and the valve (7) opens, as also the exhausting reed valve (8) of the compressor does, resulting the air to enter the engine cylinder (2). In that way the charging of the engine cylinder (2) with the fresh air is enabled, and also scouring out, by the excess of air, the rested combustion gas from that very cylinder; all this being possible because the diameter of the compressor cylinder (1) and the diameter of the engine cylinder (2) are different in such way that Dk>Dm (FIG. 4*a*). FIG. 4*b* shows the moment when the compressor piston (3) has reached the UDP and delivered to the engine all sucked air, while the engine piston (4) has passed the half of the stroke and is compressing the air-fuel compound because the exhausting channel (15) is overlapped and closed by the engine piston (4) and the injector (11) has injected the fuel into the cylinder (so the engine of the present invention has no fuel losses as the two-stroke engines of the prior art have). Now the pressure in the engine is exceeding the pressure in the compressing pipe (5) thus enabling the spring (6) to shut the valve (7). FIG. 4*c* shows the moment when the compressor piston (3) has passed the half of the stroke and is sucking the fresh air through the inlet reed valve (9), where the amount of that air is controlled by the throttle (10). At the same moment the engine piston (4) has reached the UDP and finished the compression of the air-fuel compound, and also the sparking plug (13) is starting the ignition. FIG. 4*d* shows the moment when the compressor piston (3) has reached the LDP and finished the sucking of the air, while the engine piston (4) has passed the half of the stroke driven by the combustion gas. FIG. 4*e* shows the compressor piston (3) compressing the air, while the engine piston (4) has reached the LDP. The combustion gas, assisted by the excess of air from the compressor, has gone to the atmosphere passing through recently opened exhausting channel (15) and through the rotative exhausting valve (14). The cycle is repeating.

Present Invention Advantages:

The difference between the compressor cylinder (1) diameter and the engine cylinder (2) diameter (Dk>Dm, from FIG. 4*a*) gives us the opportunity to charge the engine with the desired amount of the fresh air and to have the excess of air for scouring, what is not possible at the two-stroke engines of the prior art.

The expansion is longer because the exhausting channel (15) is positioned lower than it is possible to do at the two-stroke engines of the prior art. See H1 at FIG. 4*a*

By mutual coupling of several models it is easily possible to obtain multiline engines.

DESCRIPTION OF THE DRAWINGS

Meaning of the numbers at the FIGS. 1, 2, 3, and 4:

1. compressor (pump) cylinder
2. engine cylinder
3. compressor (pump) piston; two-sided piston at FIG. 1 and one-sided piston at FIG. 3
4. engine piston; two-sided piston at FIG. 1 and one-sided piston at FIG. 3
5. compressing pipe
6. spiral spring
7. inlet valve of the engine
8. exhausting reed valve of the compressor
9. inlet reed valve of the compressor
10. throttle
11. injector
12. crankshaft
13. sparking plug
14. rotative exhausting valve

15. through-hole (channel) in the engine cylinder

16. rod

17. two-sided piston (engine-compressor)

Figure 1:
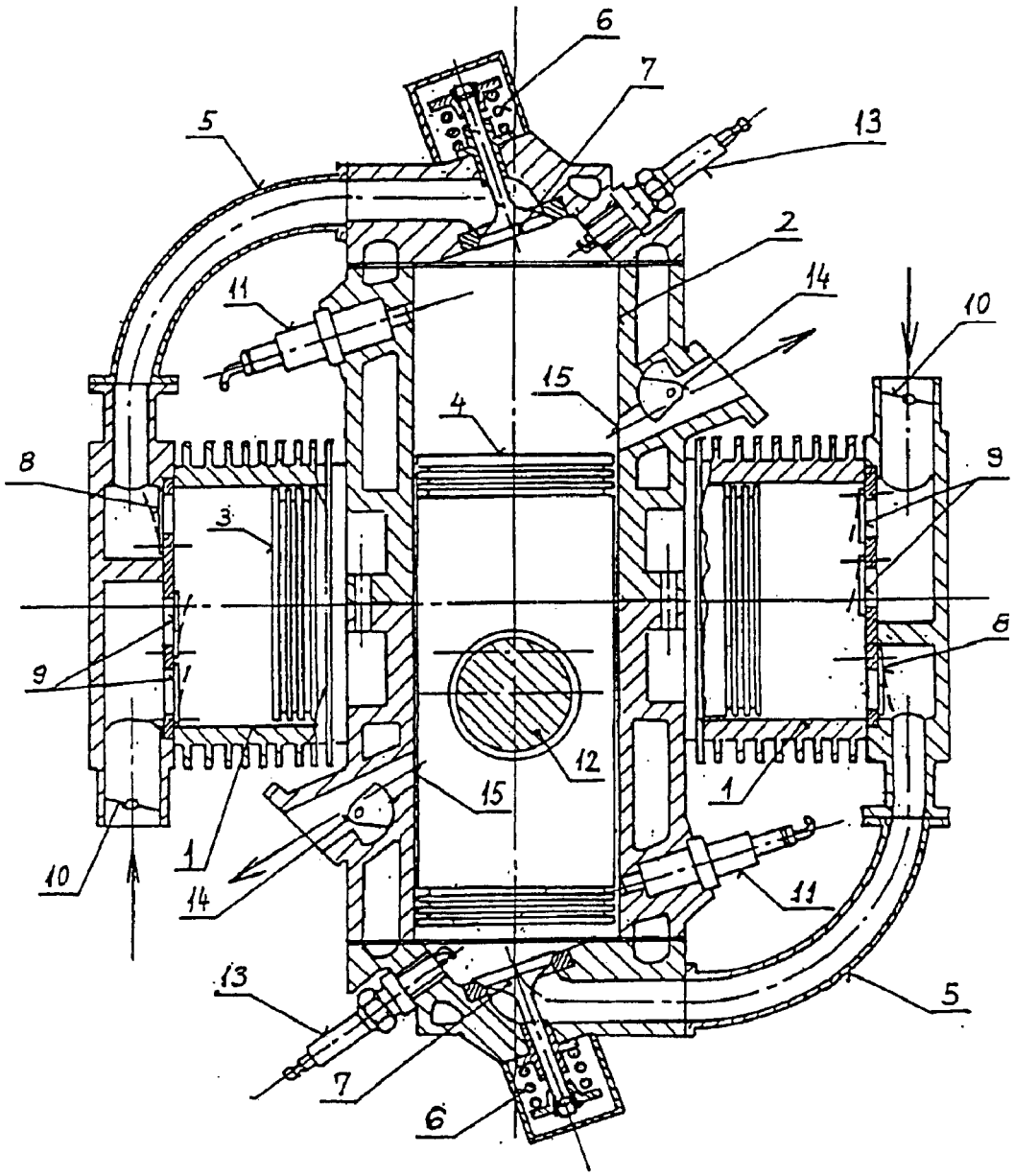
Figure 2:
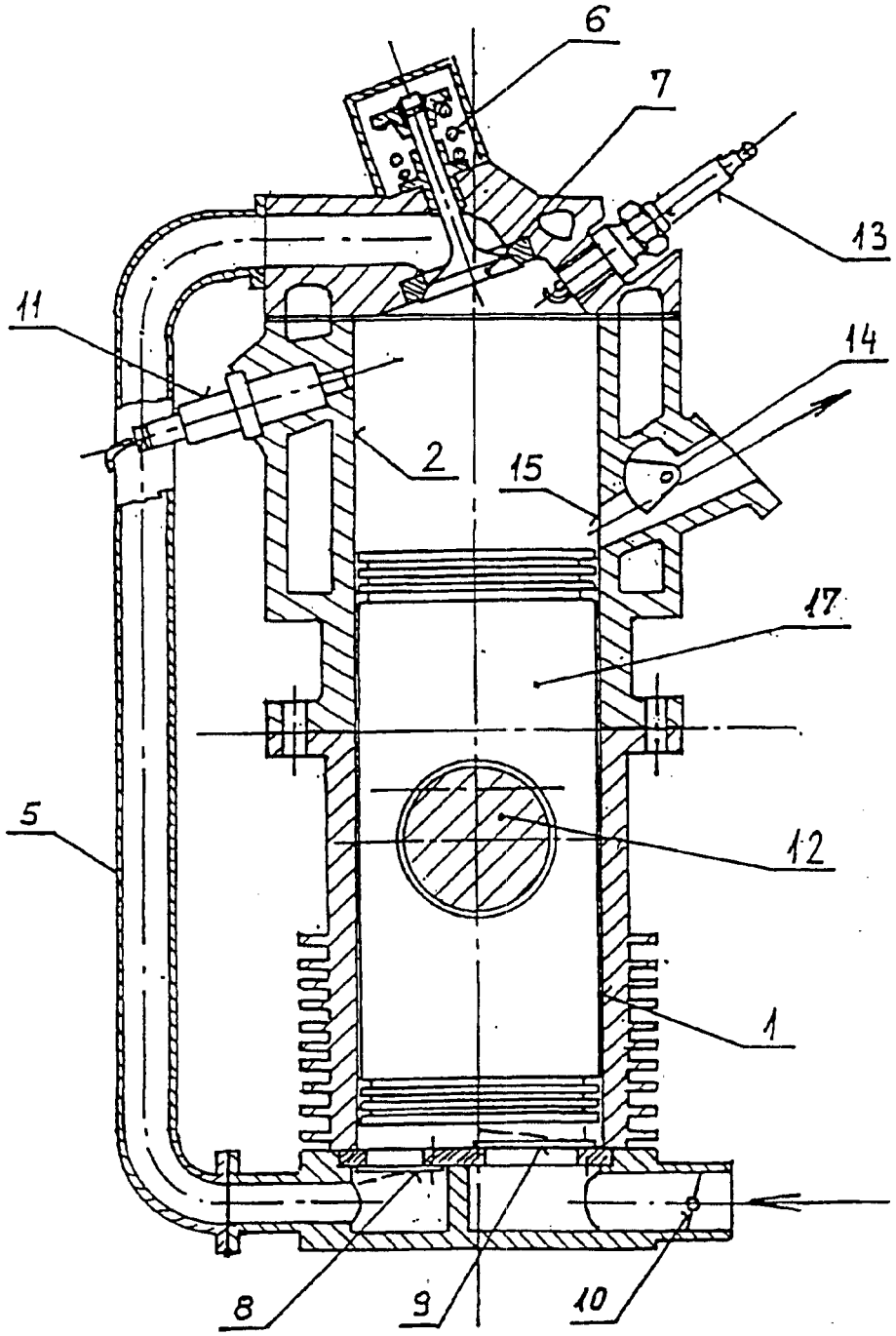
Figure 3:
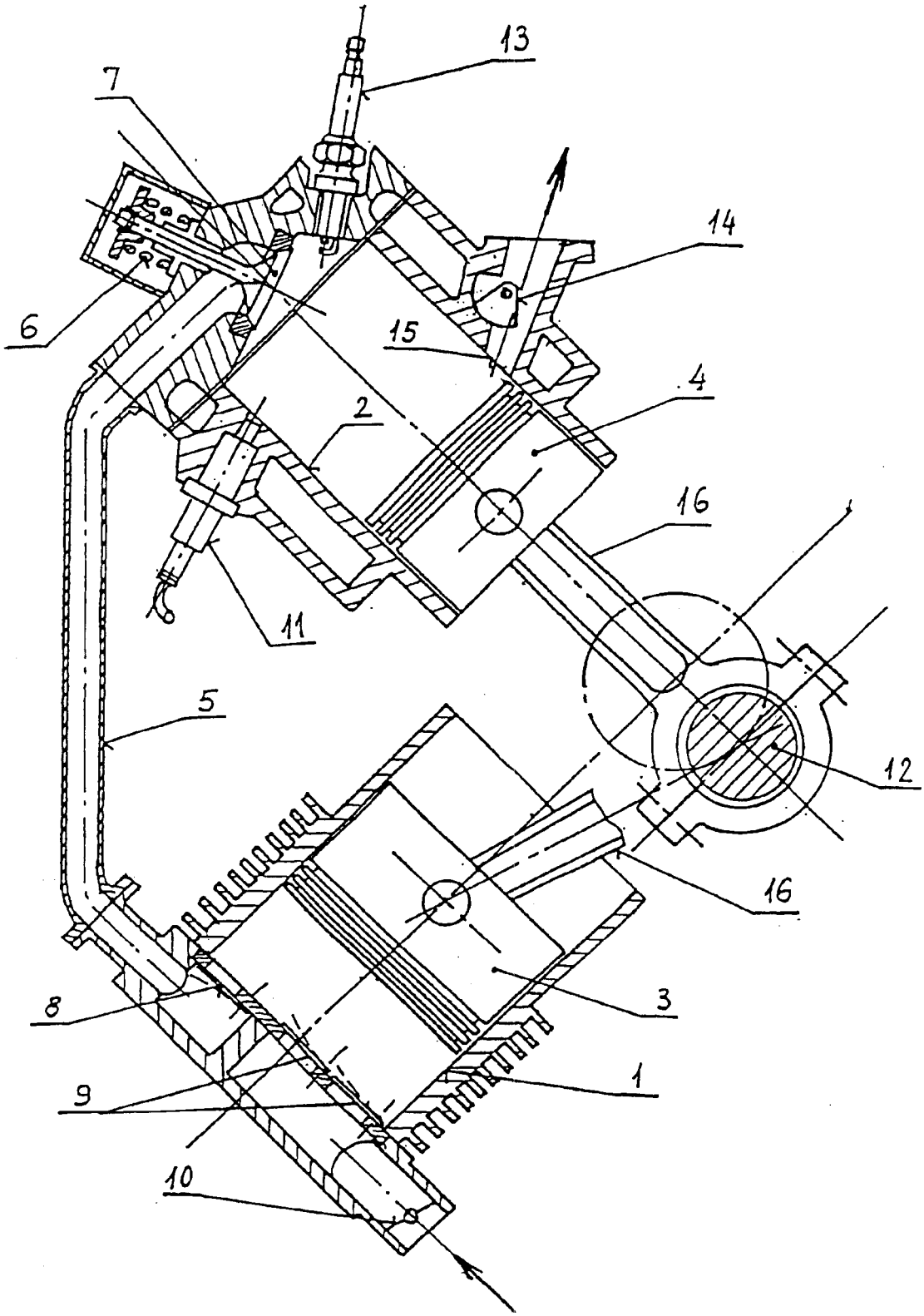
Figure 4:
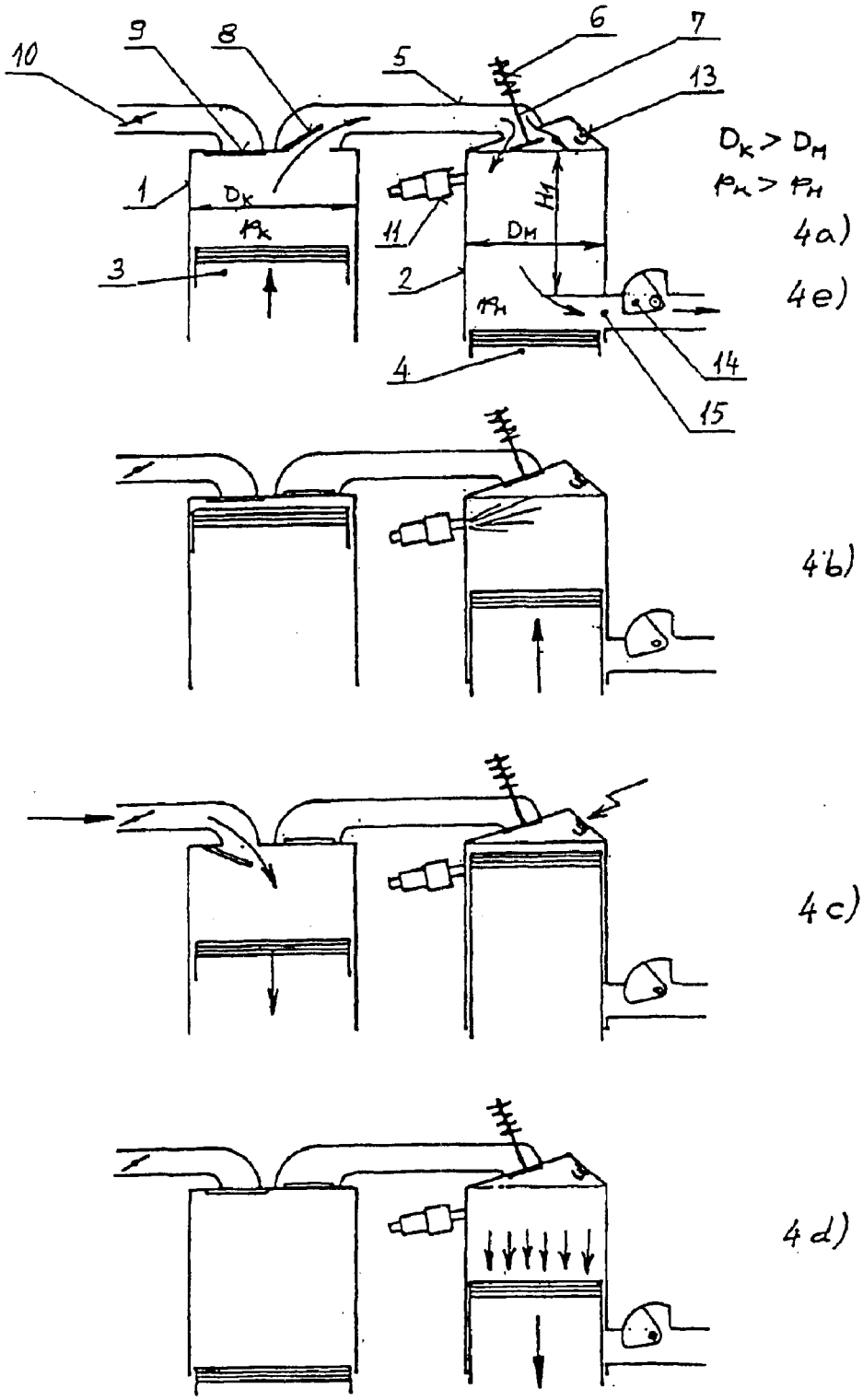

One of the inventive engine designs:

FIG. 1 shows two-cylinder "X" engine with two two-sided pistons. One piston acts as the compressor piston (3), and other acts as the engine piston (4), while the compressor and engine chambers are connected with each other via compressing pipe (5). For the strain is not high, the compressor valves (8) and (9) are performed as reed ones, while the inlet valve (7) of the engine, which suffers more strain, is performed as standard one. In the exhausting channel of the engine cylinder, the rotative valve is installed for better engine functioning.

What is claimed is:

1. A two stroke cycle internal combustion engine comprising at least one pair of cylinders of which one cylinder is a compressor cylinder and the other cylinder is an engine cylinder, each cylinder houses one piston, the pistons having a phase delay with respect to each other in a way that when one of the pistons is in one of the lower dead and upper dead points, the other piston is in a midpoint between the lower dead point and the upper dead point and vice-versa, the compressor cylinder being connected with the engine cylinder via a compressing pipe and the compressor cylinder has an inlet reed valve and an exhausting reed valve, while the engine cylinder has inlet valve from the compressing pipe opened by a pressure difference between the compressing pipe and the engine cylinder and closed by a spring force on the inlet valve when the pressure difference becomes zero, and the engine cylinder also has an exhausting channel including an exhausting rotative valve.

the compressor cylinder having a diameter larger than a diameter of the engine cylinder.

2. The two stroke cycle internal combustion as claimed in claim 1, wherein the exhausting channel of the engine cylinder is covered by the piston of the engine cylinder when the piston of the engine cylinder is located at the midpoint between the lower dead point and the upper dead point.

3. The two stroke cycle internal combustion as claimed in claim 1, wherein the exhausting channel of the engine cylinder is located at an opposite end of the engine cylinder from the inlet valve.

* * * * *